US005177985A

United States Patent [19]

Igarashi et al.

[11] Patent Number: 5,177,985

[45] Date of Patent: Jan. 12, 1993

[54] COLLECTOR/REMOVER OF DUST OF FLOCKS IN KNITTING MACHINE

[75] Inventors: Yoshiaki Igarashi; Kosaku Iida, both of Hyogo, Japan

[73] Assignee: Precision Fukuhara Works, Ltd., Hyogo, Japan

[21] Appl. No.: 869,460

[22] Filed: Apr. 16, 1992

[30] Foreign Application Priority Data

Apr. 22, 1991 [JP] Japan ..... 119439

[51] Int. Cl.[5] ..... D04B 35/32; A47L 5/00

[52] U.S. Cl. ..... 66/168; 15/301

[58] Field of Search ..... 66/168; 15/300.1, 301, 15/306, 316, 345; 138/1 C; 242/131, 131.1; 57/304, 305

[56] References Cited

U.S. PATENT DOCUMENTS

| | | | |
|---|---|---|---|
| 3,459,010 | 8/1969 | Ferri | 66/168 |
| 4,563,884 | 1/1986 | Kunde et al. | 66/168 X |
| 4,691,536 | 9/1987 | Yorisue et al. | 66/168 |
| 4,784,349 | 11/1988 | Renwick et al. | 242/131.1 X |
| 5,012,546 | 5/1991 | Kawabara et al. | 139/1 C X |

FOREIGN PATENT DOCUMENTS

| | | | |
|---|---|---|---|
| 2126140 | 9/1972 | Fed. Rep. of Germany | 66/168 |
| 2621946 | 12/1977 | Fed. Rep. of Germany | 66/168 |
| 376039 | 4/1964 | Switzerland | 15/301 |
| 527942 | 10/1972 | Switzerland | 66/168 |
| 118940 | of 1959 | U.S.S.R. | 66/168 |

*Primary Examiner*—Andrew M. Falik
*Assistant Examiner*—John J. Calvert
*Attorney, Agent, or Firm*—Bell, Seltzer, Park & Gibson

[57] ABSTRACT

Fiber waste generated adjacent the knitting section of the knitting machine and adjacent yarn feeding devices of the machine is blown to a filter adjacent the top of the machine. The lint is removed from the filter by a rotatable filter cleaner and then is transported by suction to a vacuum device outside of the machine. A blower for blowing fiber waste from the yarn feeding devices is mounted upon a support ring and undergoes reciprocal movement about a path of travel defined by such ring. In one embodiment the ring undergoes rotational movement and the blowing means moves with it, while in another embodiment the ring is stationary and the blowing means moves relative to it.

9 Claims, 4 Drawing Sheets

COLLECTOR/REMOVER OF DUST OF FLOCKS IN KNITTING MACHINE

FIELD OF THE INVENTION

This invention relates to an apparatus for collecting and removing lint, dust and similar material, hereinafter referred to as fiber waste, from a circular knitting machine, and particularly from components at or adjacent the knitting section of such machine.

BACKGROUND OF THE INVENTION

The number of yarn supply bobbins associated with a circular knitting machine may number from thirty to over one hundred. Particularly when the fabric being knitted is made from cotton yarn, the fiber waste generated by engagement between the yarn and the yarn feeding and guiding devices of the knitting machine is quite substantial. The fiber waste problem is further aggravated by the fact that knitting machines tend to be operated at increasingly faster speeds, which increases the rate at which fiber waste is generated.

After the fiber waste has become airborne, it may settle upon the yarn feeding and guiding devices or other components of the knitting section of the knitting machine where it was generated, or upon one or more neighboring machines. This increases the possibility of yarn breakage, defective stitch formation, and other undesirable results that adversely affect the quality of the knitted fabric.

Previously proposed apparatuses for removing fiber waste from circular knitting machines have employed fans or air blowers located above the machines. However, these merely displace the fiber waste from one location to another, and do not collect the same. It has also been proposed to enclose each of the knitting machines in a curtain-like sheet, and to provide adjacent each machine an exhaust duct into which a machine operator may introduce the fiber waste generated by the machine and collected by the operator. Providing separate exhaust ducts in association with each of the knitting machines would be quite expensive, however. Additionally, the curtain-like sheets limit access to the knitting machines, and rapidly become unsanitary due to adherence of lint, oil, dirt and the like to them.

SUMMARY OF THE INVENTION

The present invention provides relatively simple and low priced apparatus for efficiently effecting removal and collection of fiber waste from circular knitting machines, and for thereby maintaining such machines and the plants in which they are located in a clean condition. This in turn decreases yarn breakage, defective stitch formation and similar consequences detrimental to production of high quality fabric.

In one embodiment thereof, the apparatus of the invention includes suction and blowing means disposed above and generally centrally of the knitting section of the knitting machine, filter means located above the suction/blowing means, cleaning means for cleaning the filter means, drive means for at desired times rotating the cleaning means, and a suction duct located below the suction/blowing means.

In another embodiment the apparatus of the invention includes suction/blowing means disposed above and centrally of the knitting section of the knitting machine, filter means located above the suction/blowing means, filter driving means for imparting rotation to the filter means at desired times, and a suction cylinder located below the suction/blowing means.

In still another embodiment the apparatus is similar to those described above, but the suction/blowing means is located within the suction duct associated with the suction/blowing means.

In each of the embodiments, it is desirable to provide additional blowing means mounted by suitable means for movement to locations outwardly of and in confronting relation to the yarn feeding devices of the knitting machine. The mounting means may include a bearing housing located adjacent the upper central part of the knitting machine, a horizontally and radially extending member supported for rotation by the bearing housing, an extendible pipe connected to the horizontal member, and a ring to which the extensible pipe is coupled by a vertical shaft.

The additional blowing means of the apparatus may consist of a motor driven fan or of at least one air ejection pipe for ejecting air through a nozzle adjacent its tip. Preferably the nozzle is made of elastic material and is attached to the end of the air ejection pipe and undergoes wobbling motion.

During operation of the apparatus the suction/blowing means overlying the knitting section of the knitting machine causes the fiber waste generated at the upper part of the knitting section to be moved upwardly through the suction duct associated with the suction/blowing means. The fiber waste exiting from the upper end of the duct engages and adheres to the interior side wall of the filter. Thereafter the fiber waste adhering to the interior side wall of the filter is conducted, by a suction nozzle located adjacent the aforesaid wall of the filter, to a suction device outside of the knitting machine. In one embodiment, the filter means is stationary and the suction nozzle rotates relative to the filter means. In other embodiments, the suction nozzle is stationary and the filter rotates relative to it.

In each of the embodiments the air flow generates by the blowing means facing the yarn feeding devices is attracted to the air flow produced by the suction/blowing means. Accordingly, the fiber waste generated by the yarn feeding devices is also conducted to the filter means and then is sucked from the filter to the suction device located outside the machine. Removal and withdrawal of the fiber waste from both the knitting section and the yarn feeding devices is therefore effected.

DESCRIPTION OF THE ILLUSTRATED EMBODIMENTS

Figure 1:
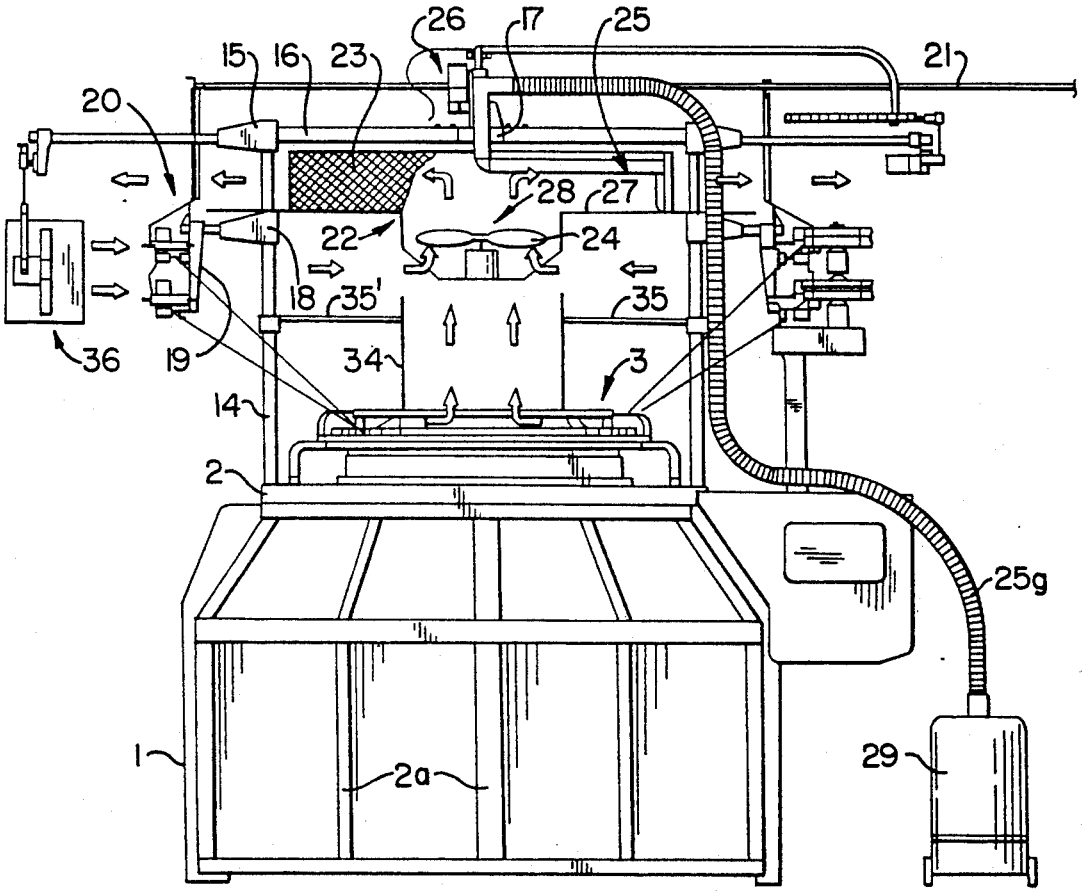
FIG. 1 is a front elevational view of a circular knitting machine having an apparatus for collecting fiber waste, which apparatus includes a suction/blowing means underlying a filter and further includes a blowing means disposed outside of yarn feeding devices of the machine.
Figure 2:
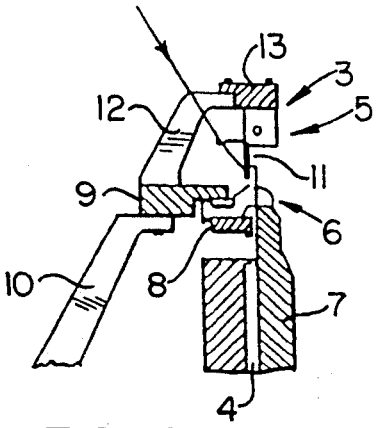
FIG. 2 is an enlarged fragmentary sectional view of components of the knitting section of the knitting machine of FIG. 1.

FIG. 1 of the drawings shows a circular knitting machine 1 equipped with fiber waste collecting and removing apparatus 22 in accordance with a first embodiment of the invention. Machine 1 has a knitting section 3 that extends upwardly from a bed 2 supported by a plurality of legs 2*a*. As is shown in FIG. 2, knitting section 3 customarily and illustratively includes a needle cylinder component 4, a yarn carrier component 5, a sinker component 6 and a rotary cylinder 7 having peripheral grooves within which knitting needles are vertically slidable. Cylinder 7 rotates at a speed equal to that the of the gearing (not shown) located adjacent the lower end thereof.

Sinker component 6 includes a sinker dial 8 having a large number of grooves within which sinkers are radially slidable. The sinker cap 9 of sinker component 6 is supported by a lower support member ID connected to bed 2.

The yarn carrier component 5 of machine includes a yarn carrier 11 (FIG. 2) that feeds yarn to a knitting needle. Yarn carrier 11 is supported by a yarn carrier ring 13 which is mounted above sinker component 6 by a yarn Carrier ring support member 12 (FIG. 2).

A plurality of posts 14 (FIGS. 1 and 6) extend upwardly from bed 2 to the top of machine 10. Horizontally extending members 16 are fixed to posts 14 by coupling members 15. Horizontal members 16 are connected to each other by a centrally located member 17 at which they converge and to which they are connected. A bracket 19 is connected to each post 14 by a support member 18. Yarn feeding devices 20 are located at upper and lower positions upon each bracket 19 corresponding to the positions of the respective yarn feeders. The yarn is fed to feeding devices 20 from an adjacent creel stand (not shown) through a yarn introducing pipe 21.

The apparatus 22 for collecting and removing fiber waste includes a stationary annular filter 23 adjacent the upper part of machine 1, suction/blowing means illustratively in the form of a motor driven fan 24, a filter cleaning means 25 which rotates around the interior wall of filter 23, and drive means 26 for imparting rotation to cleaning means 25.

Filter 23 may be divided into two or more parts that are capable of being joined together for use. A large number of perforations are provided in the surface of filter 23. There are preferably 20–40 perforations per square inch, and more preferably are approximately 30 per square inch. In lieu of the aforesaid filter, wire nets or punched steel plates having comparable perforations may be employed.

Filter 23 has its bottom portion fixedly secured to a circular plate 27 (FIG. 3) that extends to a location adjacent the yarn feeding devices 20, of machine 10. Plate 27 has a central opening 25 beneath which there is a motor driven fan 24 that is supported by plate 27 and that produces an air flow in the direction of the arrows shown in FIG. 1.

Figure 3:
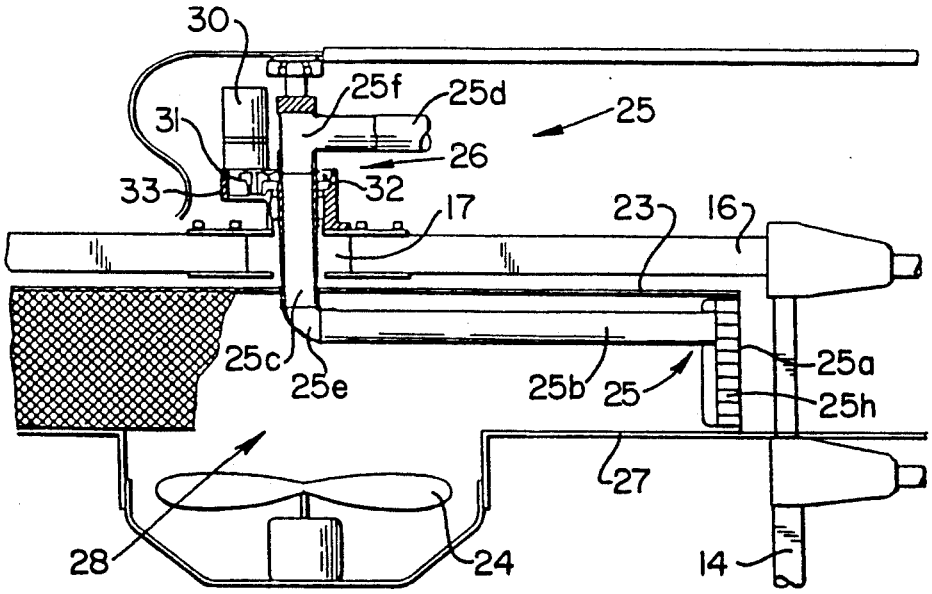
FIG. 3 is an enlarged fragmentary view, partially in vertical section and partially in side elevation, of filter means and of suction means and drive means associated with the filter means.

As is best shown in FIG. 3, filter cleaning means 25 of apparatus 22 includes a pipe having a "tip" or inlet opening 25*a*, a first horizontal section 25*b*, a vertical section 25*c* projecting from the top of knitting machine 1 along its central axis, a second horizontal section 25*d*, a connecting elbow-like section 25*e*, and a T-shaped section 25*f*. Cleaning means 25 further includes a flexible tube 25*g* that extends downwardly from horizontal pipe section 25*d* to a suction device 29 situated outside of machine 1. Inlet opening 25*a*, horizontal section 25*b*, vertical section 25*c*, and elbow 25*e* are integrally connected and are rotatable in unison with each other, while T-shaped pipe section 25*f* and second horizontal section 25*d* are connected to drive means 26.

A comb member 25*h* is secured to the inlet or "tip" opening 25*a* of pipe section 25*b*. Comb member 25*h* collects fiber waste which has accumulated on the inner wall of filter 23, and its height is substantially equal to that of filter 23. As previously noted, fiber waste passing into tip opening 25*a* of pipe section 25*b* (via comb 25*h*) is conducted through flexible tube 25*g* to suction collection device 29.

The drive means 26 for imparting rotation to filter Cleaning means 25 includes a gear motor 30, a first spur gear 31 mounted on the output shaft of motor 30, and a second spur gear 32 mounted on the periphery of vertical section 25*c* of the cleaning means and in meshing engagement with spur gear 31. By virtue of the foregoing components, operation of gear motor 30 rotates that part of cleaning means 25 consisting of vertical section 25*c*, the first horizontal section 25*b* to its tip opening 25*a*, and comb 25*h*. Opening 25*a* and comb 25*h* remove fiber waste while rotating along the inside wall of filter 23. Motor 30 is designed to periodically run at a low speed for a time set by a suitable timer or the like (not shown).

Referring once again to FIG. 1, a cylindrical suction duct 34 beneath fan 24 extends downwardly to the elevation of the upper part of rotary cylinder 7 of knitting machine 1. Duct 34 is supported by stay elements 35 that extend radially toward the center of machine 1 and that preferably define generally radially extending paths for flow of air into the upper part of duct from blowing means 36.

Upon energization of fan 24, air flows upwardly through duct 34. The air flow causes fiber waste generated adjacent the upper part of rotary cylinder 7 during the knitting process to be conducted upwardly to, and into adhering engagement with, the inner circumferential wall of filter 23. The fiber waste adhering to the inner wall of filter 23 is then removed from the filter by cleaning means 25 through its tip opening 25*a* and comb 25*h*, which are rotated along a path of travel adjacent the inner filter wall by drive mechanism 26.

Figure 4:
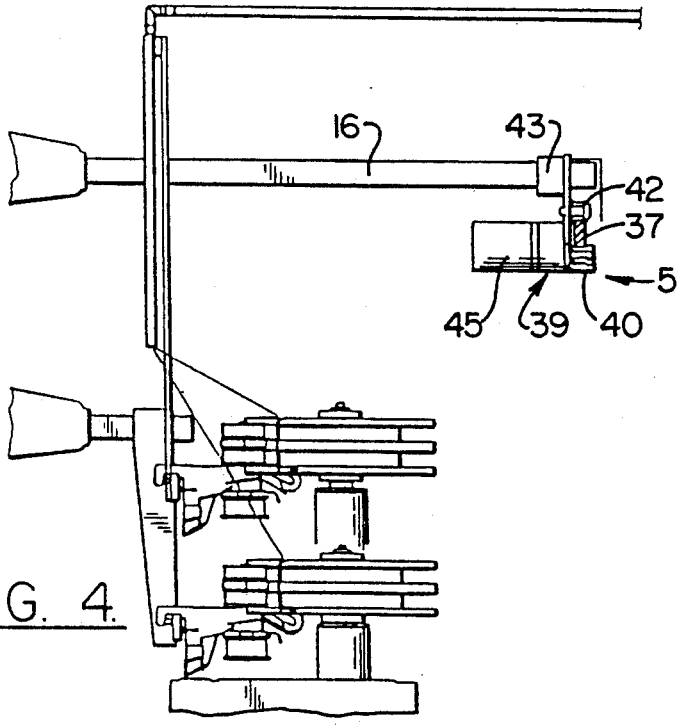
FIG. 4 is an elevational view of the drive means for moving the blowing means of the apparatus.
Figure 5:
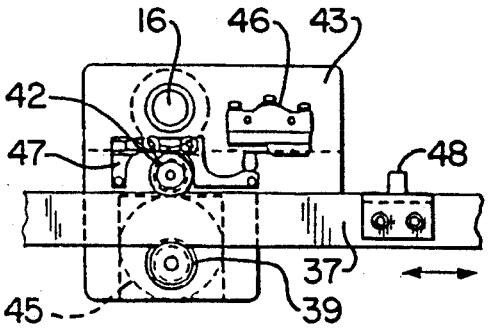
FIG. 5 is a front view of drive means and control means for effecting reciprocal movement of the blower means of the apparatus, as viewed in the direction of the arrow 5 of FIG. 4.

Referring now particularly to FIGS. 1, 4 and 5, the blowing means 36 located radially outwardly from yarn feeding devices 20 of knitting machine 1 includes a rotatable ring 37, a motor driven fan 38 supported by ring 37, and drive means 39 for imparting rotation to ring 37. Ring 37 is located directly below the outer end portion of each horizontal member 16, and is supported by support rollers 40, only one of which is shown. Guide rollers 42 (FIGS. 4 and 5) regulate up and down movement of ring 37. Supporting rollers 40, and guide rollers 42 are rotatably mounted on a bracket 43 mounted upon the outer portion of horizontal members 16. A motor 45 is attached to each bracket 43 upon which there is a supporting roller 40. Operation of motor 45 drives its output roller 39, which frictionally engages ring 37 and imparts rotational movement to the ring.

As is best shown in FIG. 5, bracket 43 further mounts a limit switch 46 actuable by a switch cam 47 that is movable along ring 37, A switch cam actuator 48 is also secured to ring 37.

Figure 6:
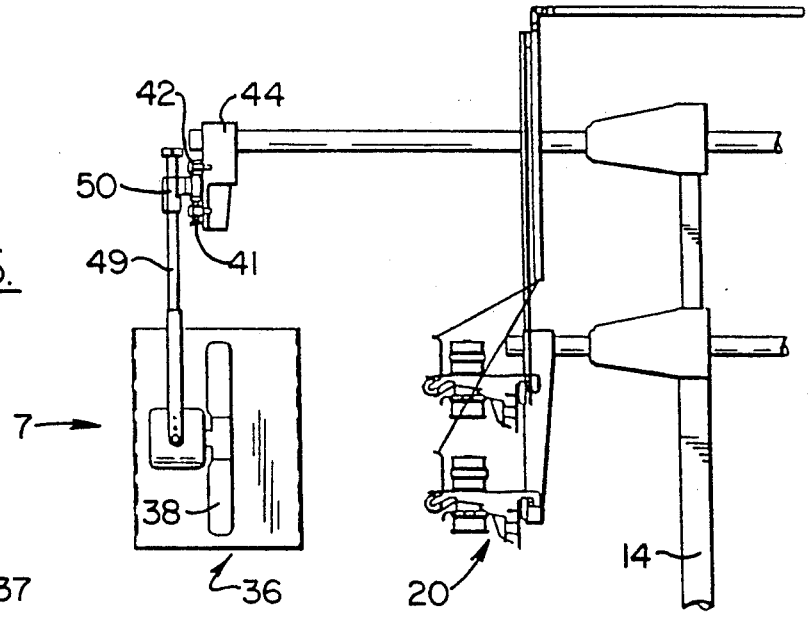
FIG. 6 is an enlarged side elevational view of yarn guiding components of the knitting machine, and of the blowing means that undergoes reciprocal movement outwardly of the yarn feeding devices.
Figure 7:
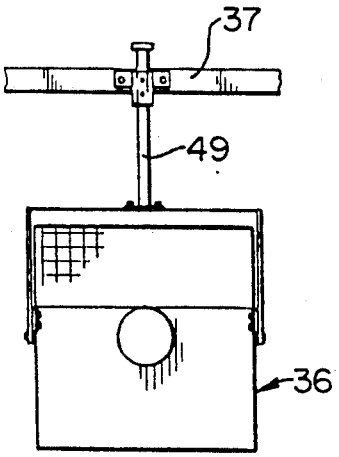
FIG. 7 is an enlarged front elevational view of the blowing means as viewed in the direction of the arrow 7 of FIG. 6.

Referring now to FIGS. 6 and 7, at least one motor driven fan 35 is supported on the outer peripheral side surface of ring 37, in a position facing the yarn feeding devices 20 of knitting machine 1.

Fan 38 is suspended for vertical adjustment by a vertical shaft 49 connected to a bracket 50 that is attached to the peripheral side surface of ring 37.

A possible alternative would be to provide blowing means 36 with an air ejection pipe of the type disclosed in Japanese Publication No. Hei 1-38899, in lieu of motor driven fan 38. In this alternative embodiment, there would be at least one air ejection pipe that ejects air through a tip opening having a nozzle made of an elastic material and that causes a wobbling motion of the nozzle. Means for adjusting the wobbling angle of the wobbling motion may be provided. The air injection pipe would be mounted on ring 37 facing yarn feeding devices 20, and would undergo rotation with the turn ring for blowing away fiber waste generated at yarn feeding devices 20.

In the embodiment of FIGS. 4 through 7, ring 37 moves horizontally and fan 38 moves in unison with turn ring 37. As an alternative, however, only fan 38 may undergo movement. In this alternative situation, turn ring 37 would be stationary, and motor 45, roller 39 and fan 38 would be integrally connected so as to move in unison with each other along the stationary turn ring 37.

Figure 8:
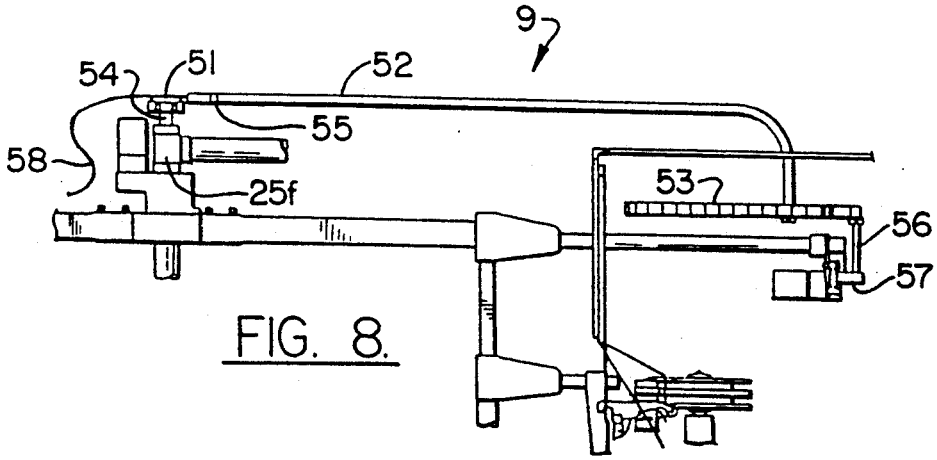
FIG. 8 is a side elevational view of components of the blower drive means of the apparatus, and of adjacent components of the knitting machine.
Figure 9:
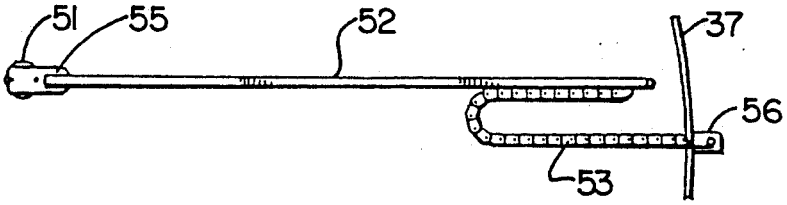
FIG. 9 is a top plan view of the FIG. 8 components as viewed in the direction of the arrow 9 of FIG. 8.

A power supply system for effecting reciprocal motion of motor driven fan 38 along ring 37 is shown in FIGS. 8 and 9. Such system includes a bearing housing 51, a hollow pipe 52 and an expansion pipe 53. Bearing housing 51 is connected to a shaft member 54 mounted on T-shaped pipe section 25*f*. A pipe fitting 55 is rotatably mounted upon bearing housing 51. A hollow pipe 2 connected to and extending generally radially from pipe fitting 55 has a generally vertically extending tip section that extends downwardly toward ring 37. The tip portion of hollow pipe 52 is connected at one end to an extendable pipe 53, and at its other end is connected to the upper portion of a vertical shaft 56. Vertical shaft 56 is held by a bearing 57 in engagement with the side surface of turn ring 37. The electrical wiring to the motor of fan 38 is conducted from the central upper part of expansion pipe 53 through the hollow pipe 52 and then is connected to the motor of fan 38.

When the blowing means 36 is energized, turn ring 37 is rotated by the supporting roller 39 (FIG. 4) driven by motor 45. As the turn ring completes one full revolution, the protruding switch cam actuator 48 (FIG. 5) engages and moves switch cam 47 (FIG. 5). Movement of switch cam 47 actuates the limit switch 46 and causes the same to reverse motor 45 and to thereby cause turn ring 37 to rotate in the opposite direction. The fan 38 supported by turn ring 37 therefore undergoes reciprocal movement in the circumferential direction in accompaniment with the rotation of turn ring 37. The extendible pipe 53 and the hollow pipe 52 follow the movement of fan 38 about the bearing housing 51.

Since the fiber waste generated at the yarn feeding devices 20 is first blown inwardly and then is blown upwardly toward filter 23, as shown in FIG. 1, such fiber waste passes to filter 23 and adheres to the inner wall thereof.

Figure 10:
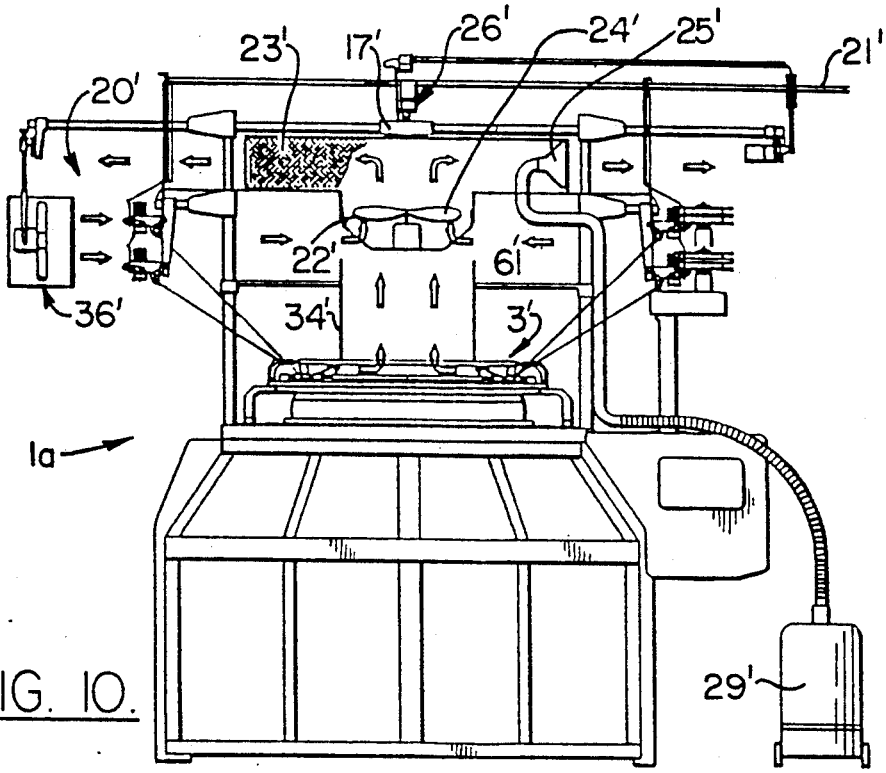
FIG. 10 is a front elevational view of a circular knitting machine equipped with apparatus for collecting and removing fiber waste in accordance with another embodiment of the invention.
Figure 11:
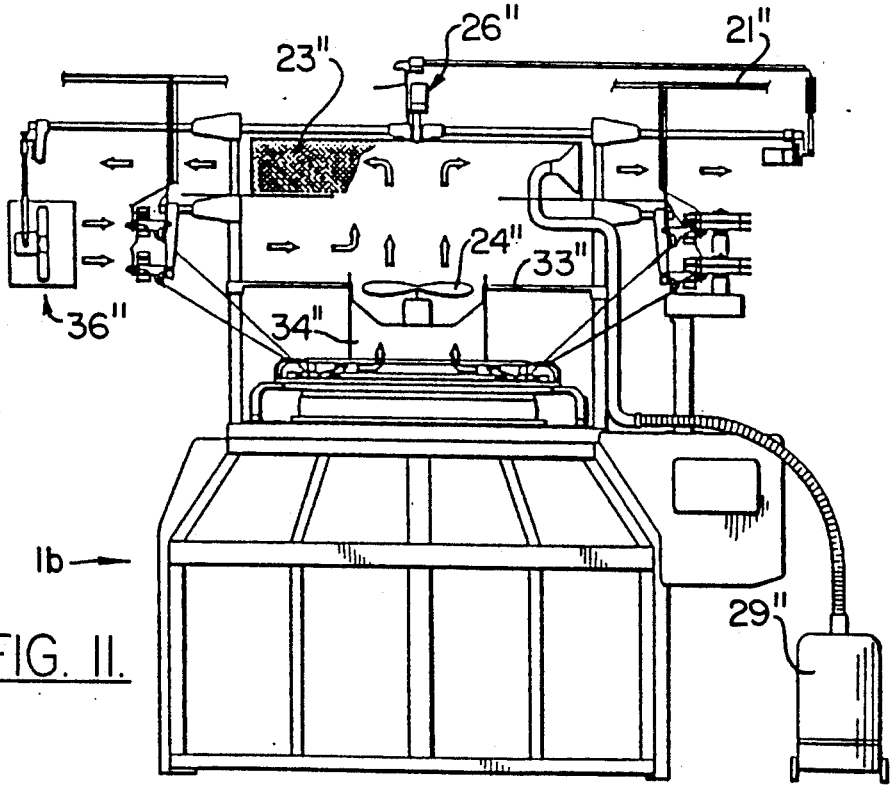
FIG. 11 is a front elevational view of a circular knitting machine equipped With apparatus for collecting and removing fiber waste in accordance with still another embodiment of the invention.

FIGS. 10 and 11 are front elevational views of circular knitting machines 1*a* and 1*b*, respectively, that are equipped with apparatus for collecting and removing fiber waste generated at yarn feeding devices 20, in accordance with the second and third embodiments of the invention. Components shown in FIG. 10 that are identical or similar to components shown in FIG. 1 are identified by the same reference numeral with the addition of a prime designation. Components shown in FIG. 11 that are identical or similar to components shown in the first embodiment are identified by the same numerals with the addition of a double prime designation.

The apparatus shown in FIG. 10 differs from that shown in FIG. 1 in that the filter 23' is rotatable and the inlet tip opening 25' of the suction device 29' that sucks fiber waste from filter 23' is fixedly secured in proximity to the inner wall of filter 23'. Thus, the relationship between the filter 23' and the tip opening 25*a'* is reversed from that of the first embodiment of the invention. The bottom portion of filter 23' is not secured to the circular bottom plate underlying such filter, so that filter 23' may be rotated by filter drive means 26'. When the motor of fan 24' is energized, air is blown upwardly as in the first embodiment. Consequently, results similar to those achieved in the first embodiment are realized.

The apparatus of the knitting machine lb of FIG. 11 includes a motor driven fan 24'' located beneath filter 23'' that blows air in the direction of the arrows past the stay members 33'' that extend from posts 14'' toward the center of the knitting machine. A cylindrical suction duct 34'' disposed about fan 24'' extends downwardly to the elevation of the upper part of the rotary cylinder of the knitting machine.

When the motor of fan 24'' is energized, air is blow upwardly to produce effects similar to those achieved in the first and second embodiments.

In contrast to prior art apparatuses, the apparatus of the present invention collects and withdraws the fiber waste as opposed to merely blowing it to another location. Consequently, knitting machines equipped with the apparatus of the present invention need not be individually shielded with a curtain-like sheet. If fiber waste should migrate to a knitting machine from a neighboring machine it will be carried by the air ejected from the blowing means to the filter, and will be collected before reaching the knitting section, thereby assuring high quality knit cloth. It will therefore be apparent that the production of the knitting machine will be improved, due to less shut-downs, and the visibility in and cleanliness of the knitting plant will be improved since shields and the like will not be needed and the amount of fiber waste floating in the air will be greatly reduced.

The hereinbefore discussed apparatuses are merely illustrative, and it will be appreciated that various modifications, and improvements of them, are possible. For example, the suction/blowing means may be housed inside the filter, and the blowing direction may be downwardly rather than upwardly. The suction nozzle may be placed adjacent the outer wall of the filter, to remove the fiber waste accumulated thereon.

What is claimed is:

1. Apparatus for collecting and removing fiber waste from a circular knitting machine having a knitting section, comprising:

suction and blowing means located above and generally centrally of said knitting section of said circular knitting machine;

filter means located above said suction and blowing means;

filter cleaning means for cleaning said filter means;

drive means for rotating said filter means; and a suction duct beneath said suction and blowing means.

2. Apparatus for collecting and removing fiber waste from a knitting machine having a knitting section, comprising:

suction and blowing means located above and generally centrally of said knitting section;

filter means located above said suction and blowing means; filter cleaning means for cleaning said filter means;

drive means for rotating said filter cleaning means; and a suction duct beneath said suction and blowing means.

3. Apparatus as in claim 1 or 2, wherein said suction and blowing means is housed in said suction duct.

4. Apparatus as in claims 1 or 2, wherein said knitting machine includes yarn feeding devices, and air flow generated by said suction and blowing means passes upwardly from an exhaust side of said suction and blowing means, and fiber waste generated adjacent said knitting section and said yarn feeding devices is conducted to said filter means by air flow generated by said suction and blowing means.

5. Apparatus as in claim 1 or 2, wherein said filter means has an inner wall and said filter cleaning means includes a comb member for collecting said fiber waste upon said wall of said filter means, and said filter cleaning means further includes a suction pipe communicating with said comb member for conducting said fiber waste from said knitting machine.

6. Apparatus as in claim 1 or 2, and further including yarn feeding devices and additional blowing means facing and located outwardly from said yarn feeding devices, and drive means for imparting movement to said additional blowing means.

7. Apparatus as in claim 6, wherein said drive means for imparting movement to said additional blowing means includes a bearing housing, a rotatable member connected to and extending generally radially and horizontally from said bearing housing, a support ring, an extendible pipe, and a vertical shaft interconnecting said support ring and said extendible pipe.

8. Apparatus as in claim 6, wherein said additional blowing means includes at least one air ejection pipe having a tip opening through which air is ejected, and a wobbling nozzle made of elastic material and attached to said air ejection pipe adjacent said tip opening thereof.

9. Apparatus as in claim 6, and further including a shield plate adjacent the upper part of said suction duct, said shield plate defining part of the path of travel for air emanating from said additional blowing means.

* * * * *

UNITED STATES PATENT AND TRADEMARK OFFICE

CERTIFICATE OF CORRECTION

PATENT NO. : 5,177,985

DATED : January 12, 1993

INVENTOR(S) : Yoshiaki Igarashi and Kosaku Iida

It is certified that error appears in the above-identified patent and that said Letters Patent is hereby corrected as shown below:

Title page, under Foreign Application Priority Data, correct "119439" to read --3-119439--

Column 2, Line 40, correct "generates" to read --generated--.

Column 3, Line 19, correct "With" to read --with--.

Column 3, Line 37, please delete "the" after the word (that).

Column 3, Line 42, correct "ID" to read --10--.

Column 3, Line 44, please add --1-- after the word (machine).

Column 3, Line 48, correct "Carrier" to read --carrier--.

Column 4, Line 12, correct "25" to read --28--.

Column 4, Line 40, correct "Cleaning" to read --cleaning--.

Column 5, Line 22, correct "," to read --.--.

Column 5, Line 25, correct "35"to read --38--.

Column 5, Line 60, correct "2" to read --52--.

Column 6, Line 54, correct "blow" to read --blown--.

UNITED STATES PATENT AND TRADEMARK OFFICE

CERTIFICATE OF CORRECTION

PATENT NO. : 5,177,985

DATED : January 12, 1993

INVENTOR(S) : Yoshiaki Igarashi, et al

It is certified that error appears in the above-indentified patent and that said Letters Patent is hereby corrected as shown below:

Column 8, Line 3, correct "claims" to read --claim--.

Signed and Sealed this

Eighteenth Day of January, 1994

*Attest:*

Bruce Lehman

BRUCE LEHMAN

*Attesting Officer*

*Commissioner of Patents and Trademarks*